US007867441B2

(12) United States Patent
Eckels et al.

(10) Patent No.: US 7,867,441 B2
(45) Date of Patent: Jan. 11, 2011

(54) LOW TO MODERATE TEMPERATURE NANOLAMINATE HEATER

(75) Inventors: J. Del Eckels, Livermore, CA (US); Peter J. Nunes, Danville, CA (US); Randall L. Simpson, Livermore, CA (US); Stefan Hau-Riege, Fremont, CA (US); Chris Walton, Oakland, CA (US); J. Chance Carter, Livermore, CA (US); John G. Reynolds, San Ramon, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 1071 days.

(21) Appl. No.: 11/634,784

(22) Filed: Dec. 5, 2006

(65) Prior Publication Data

US 2008/0131316 A1 Jun. 5, 2008

(51) Int. Cl.
*G01N 33/00* (2006.01)

(52) U.S. Cl. ..... 422/58; 422/55; 422/82.01; 422/99

(58) Field of Classification Search ..... 422/55, 422/58, 82.01, 99
See application file for complete search history.

(56) References Cited

U.S. PATENT DOCUMENTS

| | | | | |
|---|---|---|---|---|
| 4,098,258 | A | 7/1978 | Kober | |
| 5,593,792 | A | 1/1997 | Farrier et al. | |
| 6,099,556 | A | 8/2000 | Usui | |
| 6,236,028 | B1 * | 5/2001 | Shirai et al. | 219/543 |
| 7,687,746 | B2 * | 3/2010 | Tringe et al. | 219/553 |
| 2004/0234914 | A1 | 11/2004 | Hale et al. | |
| 2004/0265169 | A1 | 12/2004 | Haas et al. | |
| 2005/0136270 | A1 | 6/2005 | Besnoin et al. | |
| 2005/0142495 | A1 | 6/2005 | Van Heerden et al. | |

* cited by examiner

*Primary Examiner*—Sam P Siefke
(74) *Attorney, Agent, or Firm*—Eddie E. Scott; James S. Tak

(57) ABSTRACT

A low to moderate temperature heat source comprising a high temperature energy source modified to output low to moderate temperatures wherein the high temperature energy source modified to output low to moderate temperatures is positioned between two thin pieces to form a close contact sheath. In one embodiment the high temperature energy source modified to output low to moderate temperatures is a nanolaminate multilayer foil of reactive materials that produces a heating level of less than 200° C.

7 Claims, 4 Drawing Sheets

LOW TO MODERATE TEMPERATURE NANOLAMINATE HEATER

The United States Government has rights in this invention pursuant to Contract No. W-7405-ENG-48 between the United States Department of Energy and the University of California for the operation of Lawrence Livermore National Laboratory.

BACKGROUND

1. Field of Endeavor

The present invention relates to heaters and more particularly to a low to moderate temperature nanolaminate heater.

2. State of Technology

United States Published patent application No. 2005/0142495 for methods of controlling multilayer foil ignition by David Peter Van Heerden, published Jun. 30, 2005, provides the following state of technology information: "Reactive multilayer foils are nanostructured materials typically fabricated by vapor depositing hundreds of nanoscale layers that alternate between elements with large, negative heats of mixing such as Ni and Al. These ignitable materials support self-propagating reactions (e.g., chemical transformations) that travel along the foils at speeds ranging from about 1 m/s to about 30 m/s."

United States Published patent application No. 2004/0234914 for a percussively ignited or electrically ignited self-contained heating unit and drug-supply unit employing same by Ron L. Hale et al and assigned to Alexza Molecular Delivery Corporation, published Nov. 25, 2004 provides the following state of technology information: "Self-contained heat sources are employed in a wide-range of industries, from food industries for heating food and drink, to outdoor recreation industries for providing hand and foot warmers, to medical applications for inhalation devices. Many self-contained heating sources are based on either an exothermic chemical reaction or on ohmic heating. For example, self-heating units that produce heat by an exothermic chemical reaction often have at least two compartments, one for holding a heat-producing composition and one for holding an activating solution. The two compartments are separated by a frangible seal, that when broken allows mixing of the components to initiate an exothermic reaction to generate heat."

United States Published patent application No. 2004/0265169 for an inspection tester for explosives by The Regents of the University of California, published Dec. 30, 2004 provides the following state of technology information: "An inspection tester that can be used anywhere as a primary screening tool by non-technical personnel to determine whether a surface contains explosives. It includes a body with a sample pad. First and second explosives detecting reagent holders and dispensers are operatively connected to the body and the sample pad. The first and second explosives detecting reagent holders and dispensers are positioned to deliver the explosives detecting reagents to the sample pad. A is heater operatively connected to the sample pad."

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides a low to moderate temperature heat source. The heat source of the present invention is a heating system that utilizes a high temperature energy source modified to output low to moderate temperatures. The high temperature energy source consists of materials described as nanolaminates (thin metal foils that are laminated together using deposition techniques) that are contained between conductive and/or insulators or both. When the nanolaminate reaction is initiated, the energy produced is contained and controlled for low temperature applications. This provides Applicants' heat source.

Nanolaminates are multilayer foil structures of different materials. They are made with sputter deposition that gives well-controlled thicknesses and interfaces. The methodology currently being used is all vacuum processing which translates to no opportunity for surface oxidation. A typical nanolaminate can be described by the example of a Zr/C multiband optical coating. This coating has individual layers ranging from 0.4 nm to 8 nm. Although not necessary, the layers are of different pitches superimposed. The layers are deposited starting from a SiO2 substrate and alternately deposited. Thickness is controlled to 0.1% accuracy and uniformity across the part.

When used as an energetic material, the nanolaminates are multilayer foils of reactive materials. A representative example is the Al/Ni foil. The energy output comes from a self-sustaining reaction forming NiAl. The reaction has a DH=−59 kJ/mol (−4.07 kJ/cm3. This gives an adiabatic reaction temperature of 1639° C. Reactive nanolaminate materials have been used for specific heating applications, such as micro-welding. The nanolaminate is initiated and used as a source for high temperature heating of materials.

There are many situation where a moderate to low temperature heater is required. For example, a moderate to low temperature heater is needed for heating the sample pad of an inspection tester for explosives as disclosed in United States Published patent application No. 2004/0265169 for an inspection tester for explosives by The Regents of the University of California, published Dec. 30, 2004 which is incorporated herein by this reference. The energetic nanolaminate high temperature heat source could not be used because the high temperature would damage or destroy the sample pad. Other moderate to low temperature heat sources are disclosed in United States Published patent application No. 2004/0234914 for a percussively ignited or electrically ignited self-contained heating unit and drug-supply unit employing same by Alexza Molecular Delivery Corporation, published Nov. 25, 2004 which is incorporated herein by this reference.

The present invention provides a low to moderate temperature heat source comprising a high temperature energy source modified to output low to moderate temperatures wherein the high temperature energy source modified to output low to moderate temperatures is positioned between two thin pieces to form a close contact sheath. The two thin pieces can be insulators or conductors. In one embodiment the high temperature energy source modified to output low to moderate temperatures is a nanolaminate multilayer foil of reactive materials that produces a heating level of less than 200° C. In another embodiment the high temperature energy source modified to output low to moderate temperatures is a nanolaminate multilayer foil of reactive materials that produces a heating level of approximately 80 to 150° C. In one embodiment the high temperature energy source modified to output low to moderate temperatures is an Al/Ni laminate and said two thin pieces are two thin pieces of Al. In one embodiment, the present invention provides a method of producing heat source of low to moderate temperatures comprising providing a nanolaminate multilayer foil of reactive materials having a composition and thickness that will provide a heating level of less than 200° C. and positioning the nanolaminate multilayer foil of reactive materials between two thin pieces to form a close contact sheath.

There are advantages of using these reactive nanolaminates for energy applications. The manufacturing process produces very clean interfaces. There are no oxidized surfaces. They can be generated from common metallic constituents that are available in high purity. These components can be varied to change the energy output. Being layered materials, they also have high metals strength.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF THE INVENTION

Figure 1:
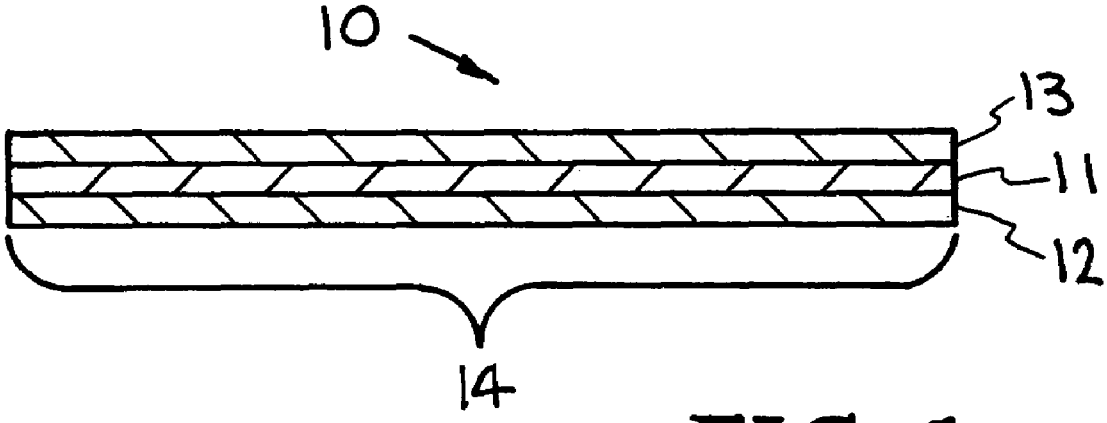
FIG. 1 illustrates one embodiment of a self contained heating system that utilizes a heat source of the present invention.

Referring to the drawings, to the following detailed description, and to incorporated materials, detailed information about the invention is provided including the description of specific embodiments. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

Referring now to the drawings, and in particular to FIG. 1, one embodiment of a heat source of the present invention is illustrated. The system is designated generally by the reference numeral 10. In the system 10 a heat source of the present invention 11 is located between two thin pieces 12 and 13 forming a close contact sheath 14. The heat source of the present invention 11 is a self contained heating system that utilizes a high temperature energy source modified to output low to moderate temperatures. The high temperature energy source consists of materials described as nanolaminates (thin metal foils that are laminated together using deposition techniques) that are contained between conductive and/or insulators or both. When the nanolaminate reaction is initiated, the energy produced is contained and controlled for low temperature applications. This provides Applicants' heat source of the present invention 11.

The heat source of the present invention 11 consists of materials described as nanolaminates (thin metal foils that are laminated together using deposition techniques) that are contained between conductive and/or insulators or both. When the nanolaminate reaction is initiated, the energy produced is contained and controlled for low temperature applications. The two thin pieces 12 and 13 are conductors.

Various materials may be used for the nanolaminate configuration 11. In the specific embodiment illustrated in FIG. 1, the nanolaminate configuration 11 consists of an Al/Ni laminate piece placed between two thin pieces of Al, 12 and 13, forming a close contact sheath 14. The heat is delivered to the outside of the nanolaminate/Al system 14. Any object that contacts this surface will be exposed to these temperatures. In the system 10 the nanolaminate 11 composition and thickness was selected to maintain a heating level of approximately 80 to 150° C. for 1 min.

Nanolaminates are multilayer foil structures of different materials. They are made with sputter deposition that gives well-controlled thicknesses and interfaces. The methodology currently being used is all vacuum processing which translate to no opportunity for surface oxidation.

A typical nanolaminate can be described by the example of a Zr/C multi-band optical coating. This coating has individual layers ranging from 0.4 nm to 8 nm. Although not necessary, the layers are of different pitches superimposed. The layers are deposited starting from a SiO2 substrate and alternately deposited. Thickness is controlled to 0.1% accuracy and uniformity across the part.

When used as an energetic material, the nanolaminates are multilayer foils of reactive materials. A representative example is the Al/Ni foil. The energy output comes from a self-sustaining reaction forming NiAl. The reaction has a DH=−59 kJ/mol (−4.07 kJ/cm3). This gives an adiabatic reaction temperature of 1639° C.

There are several advantages of using these reactive nanolaminates for energy applications. The manufacturing process produces very clean interfaces. There are no oxidized surfaces. They can be generated from common metallic constituents that are available in high purity. These components can be varied to change the energy output. Being layered materials, they also have high metals strength.

Reactive nanolaminate materials have been used for specific heating applications, such as micro-welding. In these applications, the nanolaminate is form by deposition methods as described above. The laminate is then formed into specific shapes that will be useful in micro-welding. The nanolaminate is initiated and used as a source for high temperature heating of materials.

The close contact sheath 14 has many uses. For example, the close contact sheath 14 can be used in a stand alone rapid test for explosives or for chemical agents to be used by field and laboratory personnel to determine the presence and types of explosives. Such a system is of interest to the US Military, EPA, Law enforcement, and other civilian agencies needing exotic self-contained heating systems. The close contact sheath 14 has many uses in private industry where there are companies that develop and market technology that requires self contained low temperature heating systems. This type of technology has power requirements that a best serviced by one-time use heaters that deliver precise amounts of heating. In addition, this type of technology generally is disposable after use. The close contact sheath 14 fits ideally into this type of technology.

Figure 2:
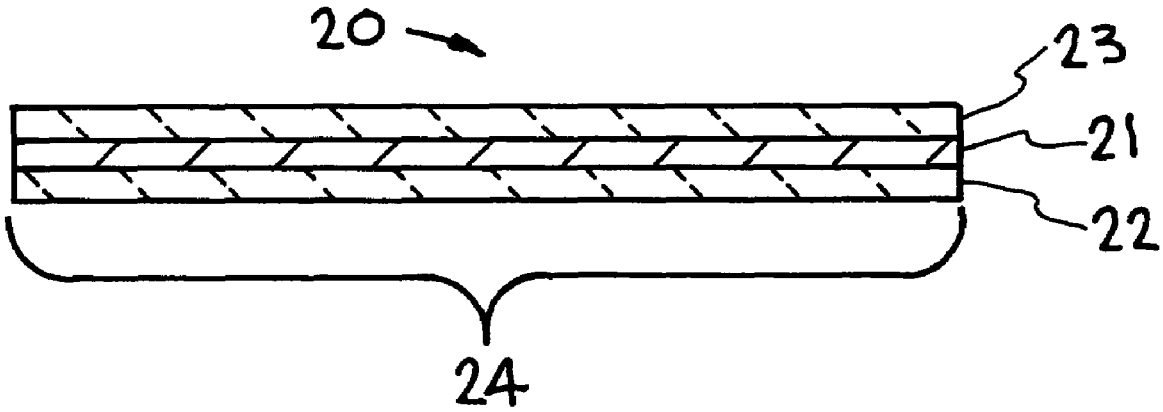
FIG. 2 illustrates another embodiment of a self contained heating system that utilizes a heat source of the present invention.

Referring now to FIG. 2, another embodiment of a self contained heating system that utilizes a heat source of the present invention is illustrated. This embodiment of a self contained heating system that utilizes a heat source of the present invention system is designated generally by the reference numeral 20. In the system 20 a heat source of the present invention 21 is located between two thin pieces 22 and 23 forming a close contact sheath 24.

The heat source of the present invention 21 is a nanolaminate. When the nanolaminate reaction is initiated, the energy produced is contained and controlled for low temperature applications. The two thin pieces 22 and 23 are insulators.

The close contact sheath 24 has many uses. For example, the close contact sheath 24 can be used in a stand alone rapid test for explosives or for chemical agents to be used by field and laboratory personnel to determine the presence and types of explosives. Such a system is of interest to the US Military, EPA, Law enforcement, and other civilian agencies needing exotic self-contained heating systems. The close contact sheath 24 has many uses in private industry where there are companies that develop and market technology that requires self contained low temperature heating systems. This type of technology has power requirements that a best serviced by one-time use heaters that deliver precise amounts of heating. In addition, this type of technology generally is disposable after use. The close contact sheath 24 fits ideally into this type of technology.

Figure 3:
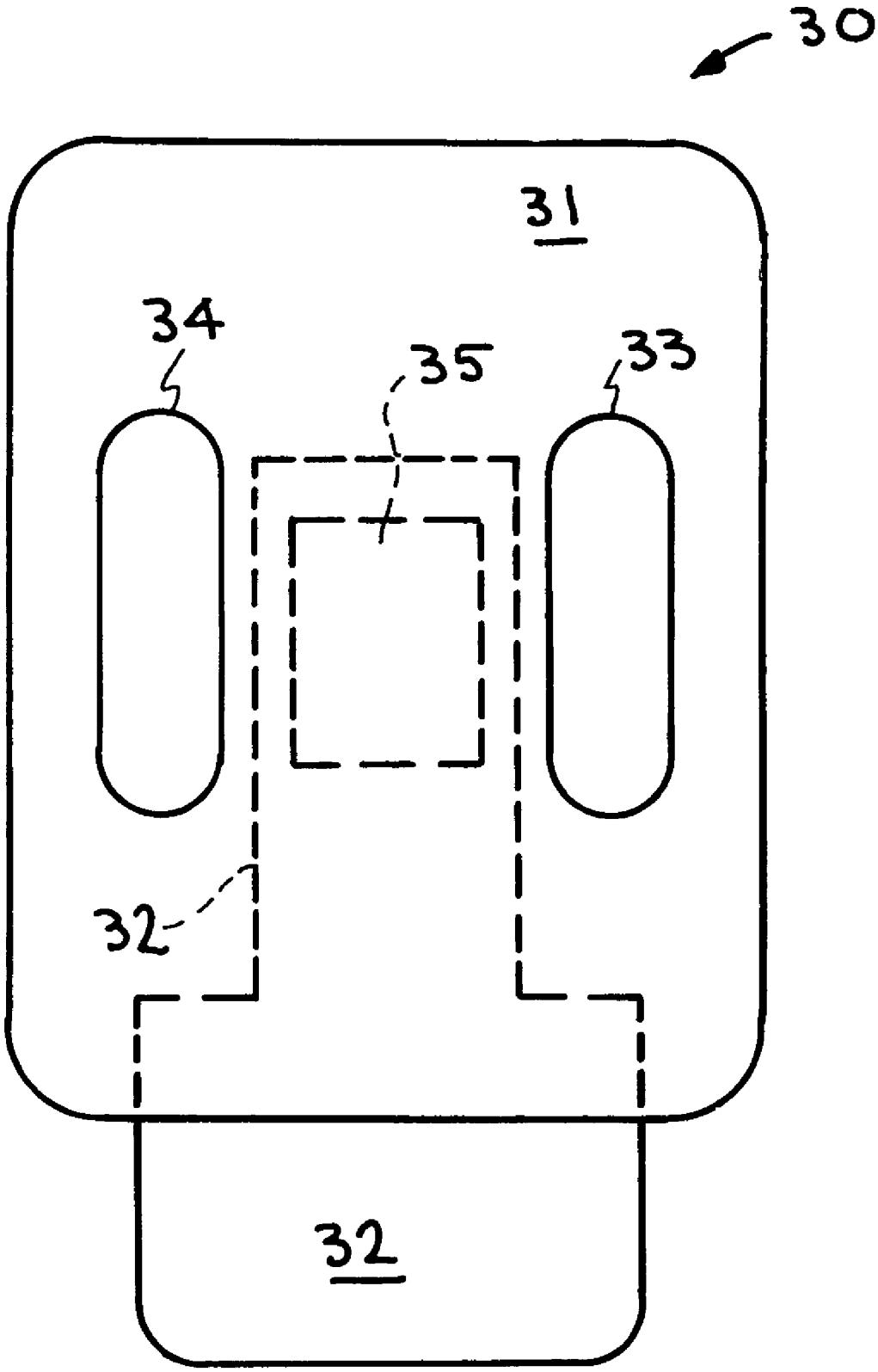
FIG. 3 shows an inspection tester and another embodiment of a self contained heating system that utilizes a heat source of the present invention constructed in accordance with the present invention.

Referring now to FIG. 3 another embodiment of a self contained heating system that utilizes a heat source of the present invention constructed in accordance with the present invention is illustrated. This embodiment of the present invention is utilized in an inspection tester. The inspection tester is designated generally by the reference numeral 30. The inspection tester 30 is an all-inclusive, inexpensive, and disposable device. The inspection tester can be used anywhere as a primary screening tool by non-technical personnel to determine whether a surface contains explosives. The inspection tester 30 is particularly useful to first responders, military, law enforcement and Homeland Security personnel.

The inspection tester 30 comprises an explosives tester body 31 and a removable swab unit 32 adapted to be removably positioned in the explosives tester body 31. The explosives tester body 31 is a thin flat body that can be described as a card. The card body 31 is made of a suitable material such as paper, wood, plastic, glass, or other suitable material. The explosives tester body 31 is thin and is less than one-fourth inch thick. The explosives tester body 31 includes a docking entry and retention portion for easy docking of the removable swab unit sample pad 32. The explosives tester body 31 also includes ampoule A 33 and ampoule B 34. In various embodiments, ampoule A 33 and ampoule B 34 are breakable ampoules, breakable glass ampoules, squeezable ampoules, and other types of ampoules.

A heater 35 illustrated by the dashed lines is used in the inspection tester body 31. The heater 35 is located beneath the removable swab unit 32. The removable swab unit 32 will be positioned directly over the heater 35 when the removable swab unit 32 is placed in position for testing a sample. The heater 35 is a heat source of the present invention located between two thin pieces forming a close contact sheath heater 35. The heat source of the present invention consists of materials described as nanolaminates (thin metal foils that are laminated together using deposition techniques) that are contained between conductive and/or insulators or both. When the nanolaminate reaction is initiated, the energy produced is contained and controlled for low temperature applications. Various materials may be used for the nanolaminate configuration.

The energetic nanolaminate has an area containing the least amount of nanolaminate material. Electrical connectors are connected to the energetic nanolaminate at locations remote from the area containing the least amount of nanolaminate material. The energetic nanolaminate is electrically initiated via joule heating. The initiation properties such as required time and energy are determined by changing only the geometry of the nanolaminate. Resistances at electrical contacts to voltage source and ground are made to be much smaller than the resistance at the point of initiation. The electrical contact is made directly to the nanolaminate at a point of highest resistance. United States Published patent application No. 2005/0142495 for methods of controlling multilayer foil ignition by David Peter Van Heerden et al published Jun. 30, 2005 shows a reactive foil in contact with electrical leads. The leads are placed on substantially opposite sides of foil and on opposite ends of the foil. The disclosure of United States Published patent application No. 2005/0142495 for methods of controlling multilayer foil ignition by David Peter Van Heerden et al published Jun. 30, 2005 is incorporated herein by this reference.

With the energetic nanolaminate, Applicants have removed these sources of variability by deliberately displacing the volume of greatest resistance away from the electrical contacts to source and ground, where resistance is instead minimized. In addition increasing the consistency of time and energy among initiation systems, this also provides a straightforward and manufacturable way of engineering precisely defined time and energy for initiation: namely by controlling the nanolaminate thickness, width and length at the constriction point where resistance is highest.

The energetic nanolaminate 11 can, for example, be an energetic nanolaminate such as an energetic nanolaminate described in the disclosures of U.S. Pat. No. 5,538,795 issued Jul. 23, 1996 to Troy W. Barbee, Jr. and Timothy Weihs; U.S. Pat. No. 5,547,715 issued Aug. 20, 1996 to Troy W. Barbee, Jr. and Timothy Weihs; and United States Published patent application No. 20050142495 by David Peter Van Heerden, et al, published Jun. 30, 2005. The disclosures of U.S. Pat. No. 5,538,795 issued Jul. 23, 1996 to Troy W. Barbee, Jr. and Timothy Weihs; U.S. Pat. No. 5,547,715 issued Aug. 20, 1996 to Troy W. Barbee, Jr. and Timothy Weihs; and United States Published patent application No. 20050142495 by David Peter Van Heerden, et al, published Jun. 30, 2005 are incorporated herein by this reference.

In the specific embodiment illustrated in FIG. 3, the nanolaminate configuration consists of an Al/Ni laminate piece placed between two thin pieces of Al forming a close contact sheath. The heat is delivered to the outside of the nanolaminate/Al heater 35. The removable swab unit 32 that contacts this surface will be exposed to these temperatures.

Referring again to FIG. 3, the operation of the explosives tester 30 will be described. The removable swab unit 32 is shown positioned in the explosives tester body 31. The heating element of the heater 35 is activated and the removable swab unit 32 will be heated as hereinafter described.

Ampoule A 33 and ampoule B 34 provide two reagent activation units. Ampoule A 33 (for reagent A) and ampoule B 34 (for reagent B) are operatively mounted on the explosives tester body 31. The ampoule A 33 containing the first explosives detecting reagent A is positioned to deliver the first explosives detecting reagent A to the reaction area of the removable swab unit 32. The Ampoule B 34 containing the second explosives detecting reagent B is positioned to deliver the second explosives detecting reagent B to the reaction area of the removable swab unit 32. The reagent A contains Meisenheimer complexes. The reagent B provides a Griess reaction. The Meisenheimer complexes and Griess reaction are well known in the art and need not be described here.

The inspection tester 30 uses a simple and rapid procedure summarized by the following four step operation:

STEP 1) A suspect surface is swiped with the removable swab unit sample pad 32. This may be accomplished by the swab unit sample pad 32 being swiped across a surface containing the suspect substance or the swab unit pad 32 may be exposed to the suspect substance in other ways such as adding the suspect substance to the swab unit sample pad 32. This will cause any explosives residue to be collected and held by the swab unit sample pad 32.

STEP 2) The breakable or squeezable ampoule A 33 is located in a position to deliver the first explosives detecting reagent A to the color reaction area of the removable swab unit 32. The breakable or squeezable ampoule A 34 is pressed to break or squeeze it thereby dispensing reagent A onto the color reaction area of the removable swab unit 32. The reagent A contacts any explosives residue that has been collected by the swab unit sample pad 32. If the swab unit sample pad 32 becomes colored, the test is positive for explosives. If no color appears the test for explosives is negative to this point.

STEP 3) If STEP 2 is negative to this point, the heater 35 is activated. This causes the swab unit sample pad 32, reagent A, and any explosives residue to become heated. If the swab unit sample pad 32 now becomes colored, the test is positive for explosives. If no color appears the test for explosives is negative to this point.

STEP 4) The breakable or squeezable ampoule B 34 is located in a position to deliver the second explosives detecting reagent B to the color reaction area of the removable swab unit 32. If STEP 3 is negative to this point, the breakable or squeezable ampoule B 34 is pressed to brake or squeeze it thereby dispensing reagent B onto the color reaction area of the removable swab unit 32. The reagent B contacts any explosives residue that has been collected by the swab unit sample pad 32. If the swab unit sample pad 32 becomes colored, the test is positive for explosives. If no color appears the test for explosives is negative to this point.

The inspection tester 30 is fast, extremely sensitive, low-cost, very easy to implement, and provides a very low rate of false positives. The inspection tester for explosives 30 provides a fast, sensitive, low-cost, very easy to implement system for testing the suspected packages. The inspection tester for explosives 30 is inexpensive and disposable. The inspection tester for explosives 30 has detection limits between 0.1 to 30 nanograms, depending on the type of explosives present. A large number of common military and industrial explosives can be easily detected such as HMX, RDX, NG, TATB, Tetryl, PETN, TNT, DNT, TNB, DNB and NC. The inspection tester 30 is designed for one-time use and can be disposed of as regular (non-hazardous) waste. Several of the devices can fit easily into a shirt pocket and can be used, for example, on vehicle door handles during routine traffic stops, on surfaces and door handles of suspicious parked vehicles, or on suspicious packages. The sample is tabbed for ease of handling and to allow recording of date, time, and sample location information.

Figure 4:
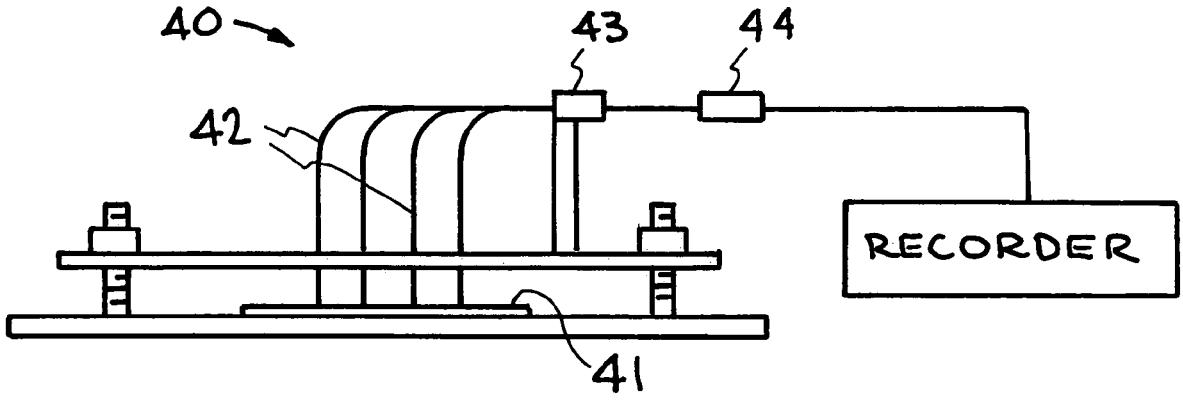
FIG. 4 shows a test apparatus for testing nanolaminate configurations.
Figure 5:
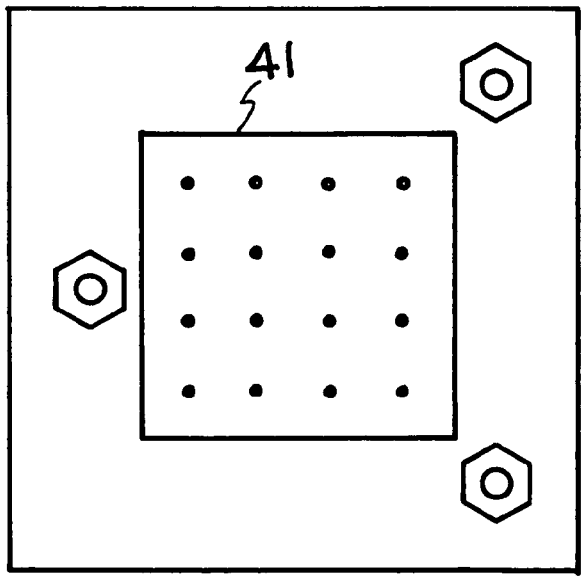
FIG. 5 shows a nanolaminate configuration.

Applicants have conducted investigation, analysis, and research of the present invention. Described below and illustrated in FIGS. 4 and 5 is a description of the performance of a nanolaminate configuration that was investigated, analyzed, and researched by Applicants. The nanolaminate configuration is designated generally by the reference numeral 40. The nanolaminate configuration 40 consists of an Al/Ni laminate piece placed between two thin pieces of Al forming a close contact sheath 41. This prepared material is then placed in a holder that allows for accurate measurement of the temperatures using micro-thermocouples 42. This device is shown in FIG. 4. Thermocouples 42 were used to monitor the temperatures upon initiation. These temperatures reflect the heat that is delivered to the outside of the nanolaminate/Al system. Any object that contacts this surface will be exposed to these temperatures. In this experiment, the nanolaminate composition and thickness was selected to maintain a heating level of approximately 80 to 150° C. for 1 min.

Figure 6:
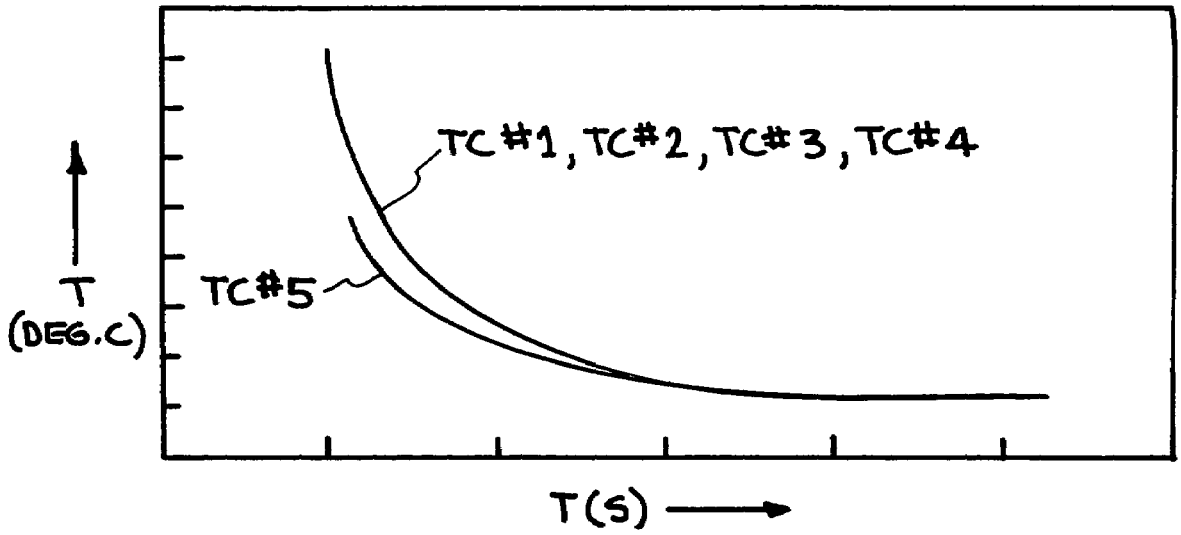
FIG. 6 is a graph showing the performance of the nanolaminate/Al system.

FIG. 6 shows the performance of the nanolaminate/Al system with the thermocouples placed directly on the outside surface of the Al sheath. Time=50.00 seconds refers to the time when the nanolaminate is initiated, at which point the temperature dramatically increases to roughly 160° C. The temperature drops then roughly exponentially in time.

TABLE 1

| | $DH_{exp}$ (J/kg) | $DH_{exp}/DH_{DSC}$ | $DH_{exp}/DH_{adiab}$ | $k_{decay}$ ($s^{-1}$) | $t_{1/e}$ (s) |
|---|---|---|---|---|---|
| Expt1 | 7.79E+05 | 0.84 | 0.63 | 0.0331 | 30.2 |
| Expt3 | 7.18E+05 | 0.77 | 0.58 | 0.0292 | 34.2 |
| Expt4 | 8.14E+05 | 0.87 | 0.66 | 0.0310 | 32.3 |
| Expt5 (wet) | 4.33E+05 | 0.47 | 0.35 | 0.0259 | 38.6 |

Table 1 shows the energetic results from modeling of the thermal curves from a series of experiments. Table 1 shows thermodynamic and kinetic properties for reactive nanolaminate low-temperature heating. These above examples show that nanolaminates are usable for low-temperature heating applications. The enthalpy results combined with the indicated information showing that enough energy is generated from the nanolaminates for the heating time constants indicate that the nanolaminates can be used for low temperature heating applications.

Figure 7:
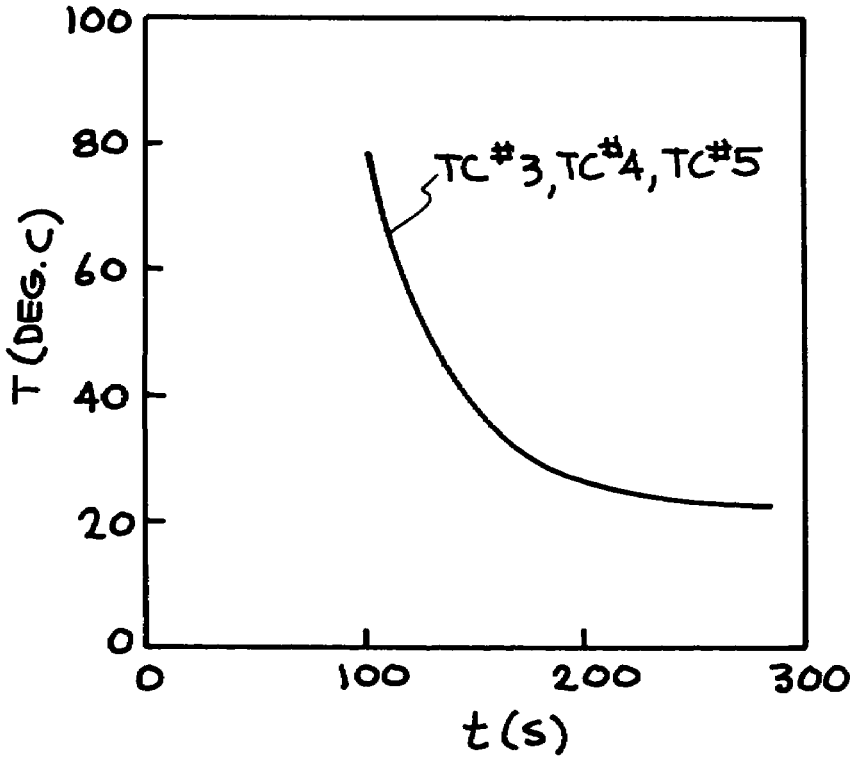
FIG. 7 is another graph showing the performance of the nanolaminate/Al system.

FIG. 7 shows the performance of the nanolaminate/Al system with the thermocouples placed on a sample material that has a solvent on it. The sample material is a polyethylene-based fibrous filter piece which has been wetted with 150 microliters of ethanol. In this experiment, the nanolaminate was designed to heat the filter to approximately 100° C. for 100 seconds while evaporating all the ethanol from the surface. The thermocouples were placed on the top surface of the filter, the surface not facing the Al sheath. t~80 sec is the initiation time for the nanolaminate, at which time the temperature rapidly increases in a few seconds reaching a maximum of around 90° C.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An inspection tester apparatus for testing for explosives, comprising:

a body, a swab unit adapted to be removeably connected to said body, at least one explosives detecting reagent positioned to be delivered to said swab unit, and a heater comprising a high temperature energy source modified to output low to moderate temperatures, said heater operatively connected to said body, wherein said swab unit is adapted to be operatively connected to said heater, said heater including a heater body portion having a point of initiation with a point of initiation resistance, a first electrical contact to a voltage source having a first electrical contact resistance, a second electrical ground contact having a second electrical contact resistance, wherein said first electrical contact resistance and said second electrical contact resistance are smaller than said point of initiation resistance.

2. The inspection tester apparatus for testing for explosives of claim 1 wherein said high temperature energy source modified to output low to moderate temperatures is a nanolaminate of thin metal foils that are laminated together wherein said metal foils have energetic material and wherein there said energetic material is located in said heater body proximate said point of initiation.

3. The inspection tester apparatus for testing for explosives of claim 1 wherein said high temperature energy source modified to output low to moderate temperatures is a nanolaminate multilayer foil of reactive materials including an aluminum/nickel laminate piece placed between two pieces of aluminum.

4. The inspection tester apparatus for testing for explosives of claim 1 wherein said high temperature energy source modified to output low to moderate temperatures is a nanolaminate multilayer foil of reactive materials that produces a heating level of approximately 80 to 150° C., wherein said heater body portion has a greater thickness, width and length of said multilayer foil of reactive materials that produces a heating level of approximately 80 to 150° C., and wherein said greater thickness width and length are located in said heater body proximate said point of initiation.

5. The inspection tester apparatus for testing for explosives of claim 1 wherein said high temperature energy source modified to output low to moderate temperatures is a nanolaminate multilayer foil of reactive materials having an aluminum/nickel laminate piece placed between two pieces of aluminum that produces a heating level of less than 200° C.

6. The inspection tester apparatus for testing for explosives of claim 1 wherein said high temperature energy source modified to output low to moderate temperatures is a nanolaminate having a composition and thickness that maintains a heating level of less than 200° C. and wherein there is a greater composition and thickness of said nanolaminate located in said heater body proximate said point of initiation.

7. The inspection tester apparatus for testing for explosives of claim 1 wherein said high temperature energy source modified to output low to moderate temperatures is a nanolaminate having a composition and thickness that maintains a heating level of 80 to 150° C. and wherein there is a greater composition and thickness of said nanolaminate located in said heater body proximate said point of initiation.

* * * * *